US009680264B2

(12) United States Patent
Polinski

(10) Patent No.: US 9,680,264 B2
(45) Date of Patent: Jun. 13, 2017

(54) MULTI-CONTACT AUDIO JACK CONNECTOR ASSEMBLY

(71) Applicant: David J. Polinski, Stuart, FL (US)

(72) Inventor: David J. Polinski, Stuart, FL (US)

( * ) Notice: Subject to any disclaimer, the term of this patent is extended or adjusted under 35 U.S.C. 154(b) by 0 days.

(21) Appl. No.: 14/867,739

(22) Filed: Sep. 28, 2015

(65) Prior Publication Data

US 2017/0093098 A1 Mar. 30, 2017

(51) Int. Cl.

| | |
|---|---|
| ***H01R 24/58*** | (2011.01) |
| *H01R 107/00* | (2006.01) |
| *H01R 103/00* | (2006.01) |
| *H01R 13/11* | (2006.01) |
| *H01R 105/00* | (2006.01) |

(52) U.S. Cl.

CPC ..... *H01R 24/58* (2013.01); *H01R 13/111* (2013.01); *H01R 2103/00* (2013.01); *H01R 2105/00* (2013.01); *H01R 2107/00* (2013.01)

(58) Field of Classification Search

CPC ..... H01R 1203/00; H01R 2105/00; H01R 2107/00; H01R 13/111; H01R 24/58

USPC ..... 439/668, 669, 265, 856, 857, 656, 723, 439/381

See application file for complete search history.

(56) References Cited

U.S. PATENT DOCUMENTS

| | | | | |
|---|---|---|---|---|
| 6,220,899 | B1 | 4/2001 | Suzuki | |
| 6,270,380 | B1 | 8/2001 | Shichida et al. | |
| 6,350,150 | B2 | 2/2002 | DeLadurantaye, III | |
| 6,533,617 | B1 * | 3/2003 | D'Addario | H01R 13/17 439/669 |
| 6,923,687 | B2 | 8/2005 | Wang | |
| 7,584,534 | B2 * | 9/2009 | Pease | A61B 1/00052 29/592.1 |
| 7,618,294 | B1 | 11/2009 | Lin et al. | |
| D607,834 | S | 1/2010 | Huang | |
| 7,654,872 | B2 | 2/2010 | Lin et al. | |
| 7,758,365 | B2 * | 7/2010 | Purchon | H01R 13/7031 439/188 |
| 7,785,119 | B1 | 8/2010 | Chiang | |
| 7,794,285 | B1 | 9/2010 | Huang | |

(Continued)

OTHER PUBLICATIONS

Switchcraft Open Frame Jack, Stereo (available on or before Nov. 6, 2012) (see Product Page, available at https://web.archive.org/web/20121106021942/http://www.switchcraft.com/productsummary.aspx?Parent=73; see Engineering Drawings, available at https://web.archive.org/web/20120522185253/http://www.switchcraft.com/Documents/12b_cd.pdf).*

*Primary Examiner* — Renee S Luebke
*Assistant Examiner* — Paul Baillargeon
(74) *Attorney, Agent, or Firm* — McHale & Slavin, P.A.

(57) ABSTRACT

Disclosed is an audio jack assembly that reduces or eliminates signal loss with an audio jack by reducing or eliminating the resistance with a conventional audio plug. The jack assembly employs a support housing having a passageway sized to receive the audio plug with an insulated first connector having first and second terminal strips, each formed integral to a first disk base and positioned to engage the grooved tip of an audio plug when engaged. A second isolated connector includes first and second terminal strips positioned to engage each side of a sleeve when the audio plug is engaged. The second connector is electrically isolated from the first connector wherein the second connector is fastened to the support housing securing the first connector therebetween.

8 Claims, 5 Drawing Sheets

(56) References Cited

U.S. PATENT DOCUMENTS

| | | | | |
|---|---|---|---|---|
| 7,874,855 | B1 | 1/2011 | Ye et al. | |
| 7,950,966 | B1 * | 5/2011 | Chen | H01R 24/58 439/668 |
| 7,967,643 | B1 | 6/2011 | D'Addario et al. | |
| 8,449,311 | B2 * | 5/2013 | Montena | H01R 13/639 439/265 |
| 8,801,476 | B2 | 8/2014 | Zhang | |
| 8,888,537 | B2 | 11/2014 | Do | |
| 2002/0037669 | A1 | 3/2002 | D'Addario et al. | |
| 2005/0037634 | A1 | 2/2005 | Khemakhem | |
| 2007/0232150 | A1 | 10/2007 | Lee | |
| 2009/0011628 | A1 | 1/2009 | Purchon | |
| 2009/0298347 | A1 | 12/2009 | Wu et al. | |
| 2011/0230087 | A1 | 9/2011 | Stantchev | |
| 2011/0237110 | A1 | 9/2011 | Montena | |
| 2016/0190753 | A1 * | 6/2016 | DeCola | H01R 24/58 439/668 |

* cited by examiner

MULTI-CONTACT AUDIO JACK CONNECTOR ASSEMBLY

FIELD OF THE INVENTION

This invention relates to the field of connectors used for audio signals, and in particular to an improved audio jack connector assembly having multiple contacts.

BACKGROUND OF THE INVENTION

Audio jacks, also referred to as phone connectors, phone jacks, or jack plugs are typically used in connector assemblies for carrying audio signals. Dating back to the late 1800's, the audio jack is one of the oldest electrical standards still in existence. The audio jack is the preferred connector for use in the music industry based upon a 6.35 mm (¼ inch) plug diameter which provides a robust assembly that can be reused indefinitely.

The size of the audio jack makes it easy to grasp without tools, and it cannot be bent if stepped upon or otherwise used in a manner expected of insertion and removal. For this reason the audio jack is the preferred connector for use with electric guitars, microphones, speakers, amplifiers, line levelers and like equipment found in the music industry, primarily audio signal transmission. The audio jack is cylindrical in shape having two, three or four contacts.

Unique to the audio jack is the amount of surface area that is provided by a cylindrical plug. However, the connector to which the plug engages is typically a single prong having a single point of contact. The single point of contact can become problematic as it needs to press against the plug in order to create a connection. The greater force the contact imparts upon the plug, the better the electrical connection; however the higher the stress placed upon the connector, which can cause the ground connector to be off center and lose contact. If the electrical contact is de minimus, the ability to transfer an electrical signal is reduced. The conventional electrical contacts employed to engage the plug provide very little contact surface, which results in poor audio quality.

Numerous attempts have been made to improve upon the audio jack. U.S. Pat. No. 7,874,855 describes an audio jack connector having an insulating housing and a passageway. A contacting terminal is disposed on a side of the passageway having a holding portion and two contacting pieces slanted toward the same side separately from two opposite ends of the holding portion. A first fixing terminal, arranged on a side of the passageway, adjacent to the contacting terminal, has a first fixing slice. The first fixing slice has a side extended obliquely to form a first contacting piece connecting with one contacting piece. A second fixing terminal placed on an opposite side of the passageway has a second fixing slice, a second contacting piece obliquely connected with the second fixing slice for connecting with the other contacting piece. The contacting pieces are forced to slide on and depart from the first contacting piece and the second contacting piece when the contacting terminal is elastically pushed by the inserted plug.

U.S. Publication No. 2007/0232150 describes an audio jack connector includes a housing and a set of contacts. The housing has a body, a mating portion extending from one end of the body, and an insertion hole defined in the mating portion and extending inwardly through the body along an axis direction. The set of contacts includes signal contacts, a set of switching contacts disposed in the housing, and an exposed contact disposed at the outside of the housing. The switching contacts have a fixed contact and a movable contact. The mating portion of the housing has a cavity defined at an outer surface thereof for receiving a contacting portion of the exposed contact. The contacting portion has a propping block protruding outwardly beyond the outer surface of the mating portion.

U.S. Publication No. 2009/0298347 describes an audio jack connector which is suitable for selectively engaging with either a first multi-pole plug or a second multi-pole plug having more poles than the first multi-pole plug. Each of the multi-pole plugs has a plurality of poles insulated with each other by insulating rings arranged thereinbetween. The audio jack connector includes an insulating housing having a chamber extending inward from a front thereof, and terminal groups. The terminal groups are disposed in the corresponding grooves and project into the chamber. When either of the first and the second multi-pole plugs is respectively inserted into the chamber, the terminal groups are against the multi-pole plug, wherein at least one of the terminal groups is against one of the insulating rings of the first multi-pole plug.

U.S. Pat. No. 6,220,899 discloses a connecting sleeve spring resiliently mounted in a connecting sleeve of an electrical connecting jack. The connecting sleeve spring has a arcuate sinusoid-like side profile, with its two ends curving in a direction opposite the curve of a center contact portion. The center portion has an inwardly angled tongue. When a plug having a collar is inserted into the electrical connecting jack, the collar comes in contact with the tongue and pushes the central contact portion inward, thus forcing the two ends of the connecting sleeve spring to move outward. The two ends press against the inner periphery of the collar.

U.S. Pat. No. 6,270,380 discloses a multipolar electrical connector that, as a counter connector 90, uses a single-head plug having a pole shaft in which center poles are disposed in plural positions in the axial direction, respectively (hereinafter, referred to merely as "multipolar connector"). In the invention, plural predetermined contact pieces are incorporated into the body, so that plural poles are ensured by the predetermined contact pieces. A required number of first additional contact pieces and second additional contact pieces are placed on the outer and inner peripheral sides of the boss portion, so that two or more poles are ensured by the additional contact pieces. According to the invention, therefore, the number of poles is increased by that of poles which are formed by the additional contact pieces.

U.S. Pat. No. 6,923,687 discloses an audio jack connector comprising a rectangular-shaped insulating housing, and a plurality of different contacts. The insulative housing has a base and a mating portion. A channel extends through the base and the mating portion. A front end of the channel defines a gap, and a number of receiving slits defined on the base at two sides of the channel, the base defining a depression communicating with the channel at a top wall thereof. A first and a second contact are received in the slits. A third contact mates with the top wall and comprises a mounting portion extending beyond the bottom wall of the insulative housing. A fourth contact is installed in a front end of the insulative housing and has an engaging portion extending through the gap and inserted into the front end of the channel for electrically connecting the mating plug connector.

U.S. Pat. No. 7,654,872 discloses an audio jack connector which includes a housing and a terminal group. The housing has an insertion hole extending inward from the front of the housing. The bottom of the base defines at least one signal terminal recess and an auxiliary terminal recess, a first aperture is defined in the bottom of the auxiliary terminal recess and communicates with the signal terminal recess. The terminal group has at least one signal terminal and an auxiliary terminal received in the signal terminal recess and the auxiliary terminal recess respectively. The signal terminal has a contact portion projecting into the insertion hole and an elastic portion extending from the end of the contact portion.

U.S. Pat. No. 7,785,119 discloses an audio jack connector having an insulating housing defining a rectangular base. The base has a passageway passing therethrough for receiving an inserted audio plug connector. A channel is formed at a top surface of the base for communicating with the passageway. A set of switch terminals mounted to the insulating housing comprise an elastic terminal and a fixing terminal. The elastic terminal has a first top plate and a switch arm extended outward from the first top plate, with a free end thereof projecting into the passageway through the channel. The fixing terminal has a second top plate disposed above the channel. The second top plate has a pair of cantilever switch slices extending toward each other and perpendicular to an extending direction of the switch arm, with free ends thereof suspended over the free end of the switch arm and spaced from each other.

U.S. Pat. No. 7,794,285 discloses an audio jack connector for receiving an audio plug connector which includes an insulating housing and a contact terminal. The insulating housing defines an insertion hole from a front end to a rear end thereof for receiving the audio plug connector and a recess communicating with the insertion hole. The contact terminal has a connecting portion received in the recess. Two opposite ends of the connecting portion are extended towards a same side to form a base portion and a first elastic arm. A first contact portion is protruded towards the base portion from a free end of the first elastic arm. A second elastic arm is bent towards the connecting portion from one end of the base portion. A second contact portion is protruded towards the first elastic arm from a free end of the second elastic arm. The first and second contact portions protrude into the insertion hole.

U.S. Pat. No. 8,801,476 discloses an electrical contact of an audio jack connector including a main portion, a soldering portion bending from a lateral edge of the main portion, an elastic portion extending curvedly from a distal end of the main portion to be located above the main portion. The elastic portion has a flexible beam, a first arm extending upwardly from the flexible beam and a second arm curvedly bending from the first arm. The first arm is consistent with a direction along which an audio plug connector is inserted. The second arm is adverse to a direction along which the audio plug connector is withdrawn.

U.S. Pat. No. 8,888,537 discloses an improved electronic audio receptacle connector which employs contacts that have multiple points of contact with a mating audio plug. The contacts each have multiple segments, each segment having a plurality of transverse fingers that interface with a conductive portion of the audio plug. The multiple points of contact improve the reliability of the receptacle connector. The housing of the receptacle connector may be made of two portions mated along an interface. The two portions may have features along the interface to impede moisture ingression and to interlock them together. U.S. Pat. No. D607,834 discloses an ornamental design for a contact of audio jack connector.

SUMMARY OF THE INVENTION

Disclosed is an audio jack assembly for receiving a conventional audio plug comprising a support housing having a passageway sized to receive the audio plug. The support housing has an insulated first connector having first and second terminal strips each having a proximal end formed integral to a first disk base and extending obliquely and symmetrically to a distal end. The distal end of the terminal strips are positioned to engage the grooved tip of an inserted audio plug/A second isolated connector with first and second terminal strips each having a proximal end extending obliquely and symmetrically from an outer edge of second disk base to a distal end are positioned to engage the sleeve of the audio plug. The second connector is positionable on the mounting collar and electrically isolated from the first connector wherein the second connector is fastened to the support housing securing said first connector therebetween.

An objective of the instant invention is to provide an audio jack assembly that reduces or eliminates signal loss between the jack receptacle and a conventional audio plug.

Another objective of the invention is to provide an audio jack assembly that employs connectors formed integral with a common base to provide a uniform clamp pressure on the sleeve and grooved tip of an audio plug.

Yet still another objective of the invention is to provide an audio jack assembly that employs a metal bias with four terminals spaced 90 degrees apart to provide a consistent pressure gradient upon an engaged audio plug.

Still another objective of the invention is to provide an audio jack assembly having scalloped terminals for engaging a larger surface area of an audio plug to assure a resistance free connection.

Yet still another objective of the invention is to provide an audio jack assembly having terminals that are maintained in position by a notched insulator ring.

Still another objective of the invention is to provide an audio jack assembly that is compact in size and easy to assemble.

Yet still another objective of the invention is to provide an audio jack assembly design that can be scaled from ¼ inch, ⅛ inch, and micro sizes.

Other objectives and further advantages and benefits associated with this invention will be apparent to those skilled in the art from the description, examples and claims which follow.

DETAILED DESCRIPTION OF THE PREFERRED EMBODIMENT

Figure 1:
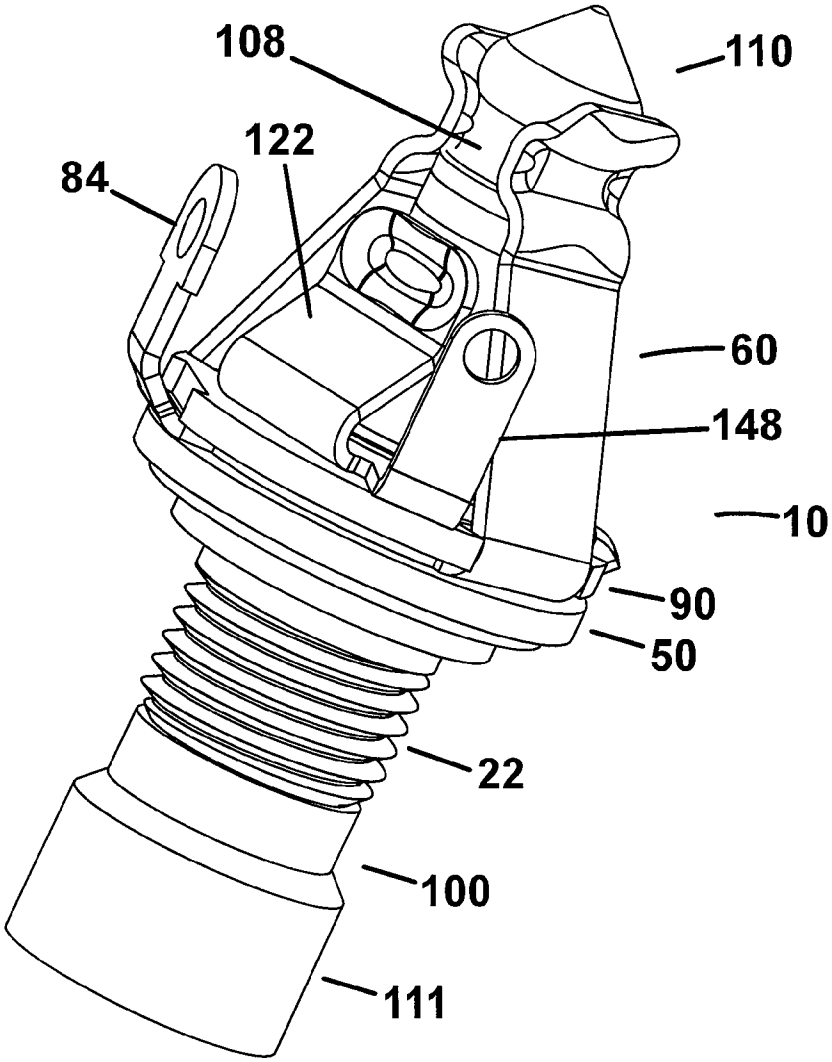
FIG. 1 is a perspective view of the audio jack assembly with a plug inserted.
Figure 2:
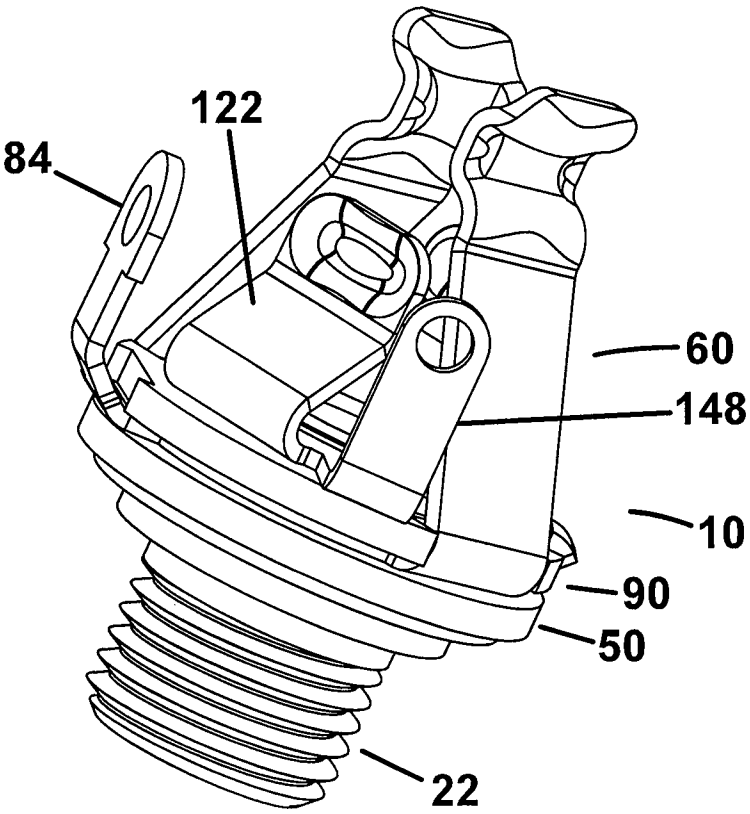
FIG. 2 is a perspective view of the audio jack assembly.
Figure 3:
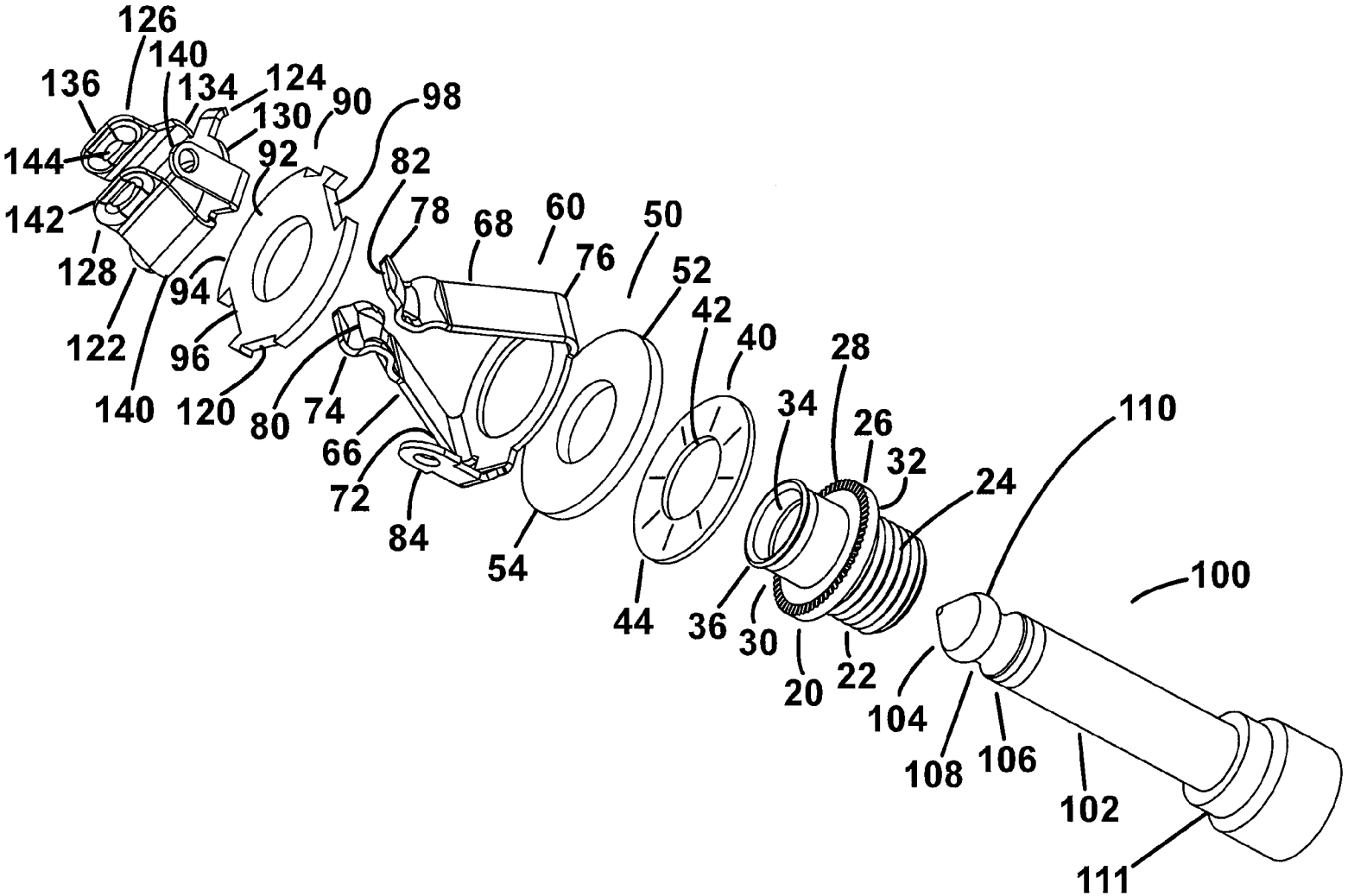
FIG. 3 is an exploded view of the audio jack.
Figure 4:
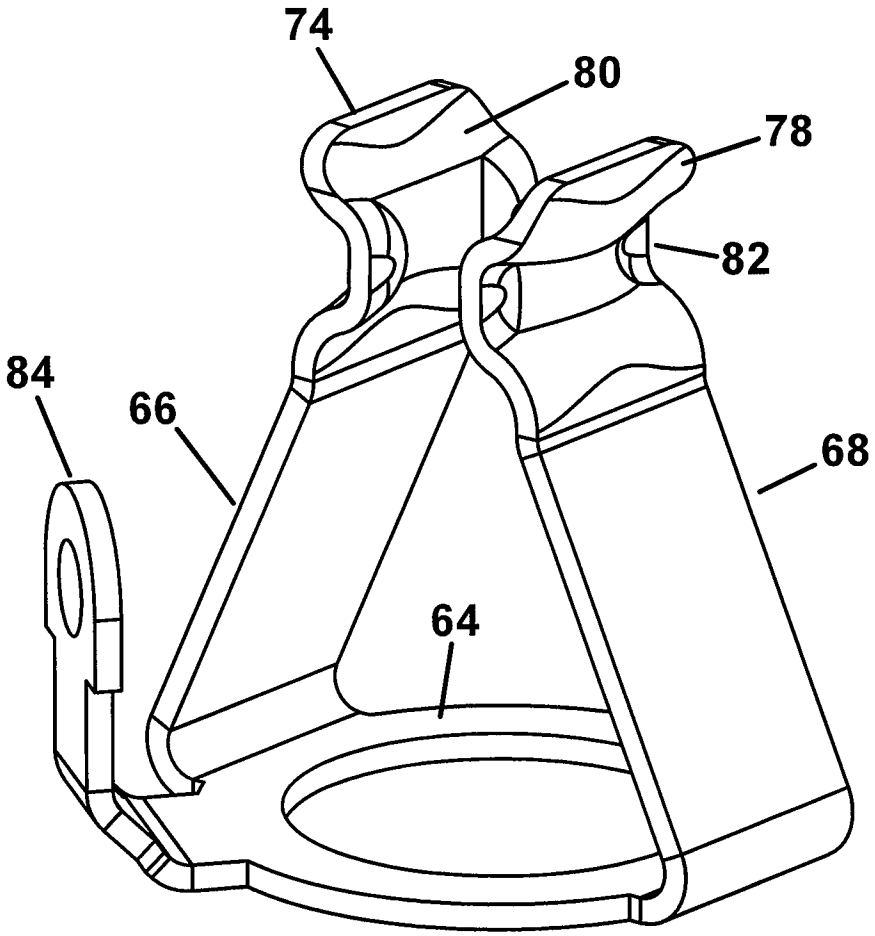
FIG. 4 is an enlarged view of the first connector.
Figure 5:
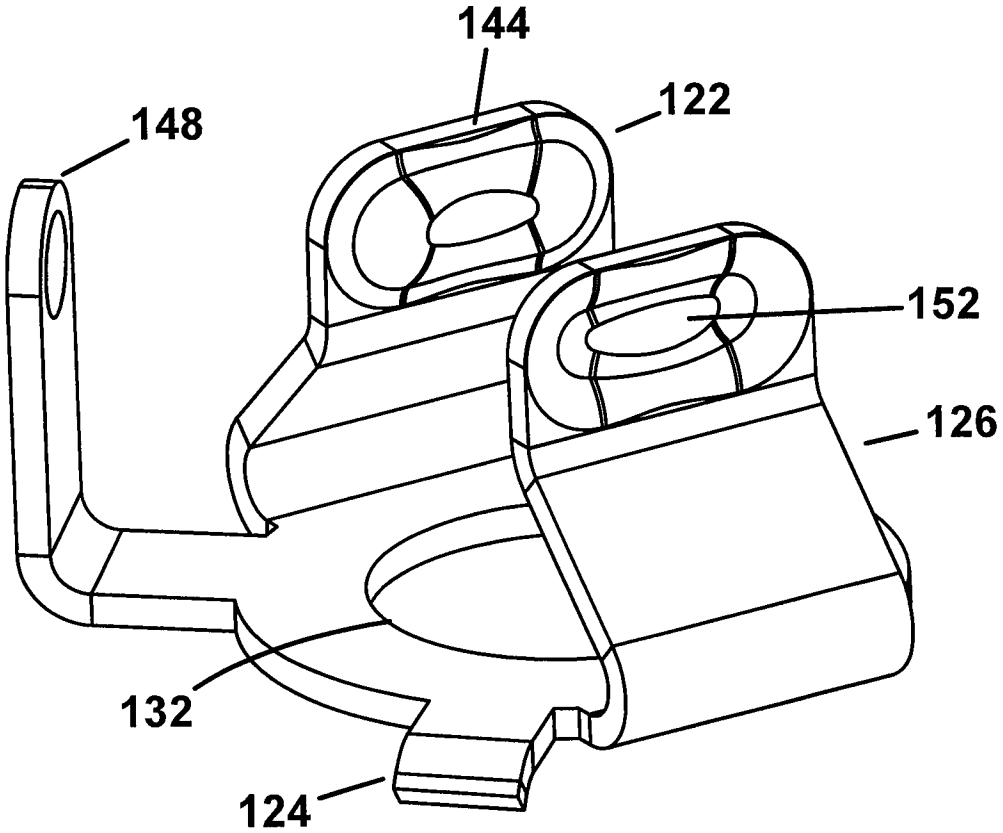
FIG. 5 is an enlarged view of the second connector.

Detailed embodiments of the instant invention are disclosed herein, however, it is to be understood that the disclosed embodiments are merely exemplary of the invention, which may be embodied in various forms. Therefore, specific functional and structural details disclosed herein are not to be interpreted as limiting, but merely as a basis for the claims and as a representation basis for teaching one skilled in the art to variously employ the present invention in virtually any appropriately detailed structure.

Now referring to the drawings, set forth is an audio jack assembly 10 for receiving a conventional audio plug 100.

The audio plug 100 that the audio jack assembly 10 utilizes is a cylindrical shaped sleeve 102 having a pointed tip 104 separated from the sleeve 102 by an insulating ring 106. The audio plug is a conventional 6.35 mm (¼ inch) plug that has been an industry standard for over a century. The depicted audio plug 100 includes a groove 108 formed in the tip 104, which operates as a detent and is commonly used for securing the audio plug 100 into a receiving jack assembly.

The instant invention is directed to an improved audio jack assembly 10, which consists of a support housing 20 having an entry collar 22 which is circular in shape and may include threads 24 for securement to a façade, not shown, commonly found on audio equipment. The threads 24 are used to secure to a securement nut, also not shown, which is a commonly known method of securement. A support surface 26 having an upper surface 28 adjoins the entry collar 22. The upper surface 28 may include friction induced surface that aids in mounting of the assembly to prevent spinning of the support housing while being threaded. The support surface 26 has a diameter which is larger than the diameter of the entry collar 22 for an adjoining mounting collar 30. In this manner, the support housing having the upper surface 28 is used for engaging the remainder of the jack assembly, and the lower surface 32 is used for engaging the façade of a mounting mechanism. The support housing has a passageway 34 extending through the mounting collar 30, the support surface 26, and the entry collar 22 to allow passage of the tip 104 and sleeve 102 until the support housing 20 engages the base 111 of the audio plug 100. The upper portion of the mounting collar 30 is shaped 36 to frictionally engage, or is threaded for use in fastening, to a second connector 122, as later described in this disclosure.

A support ring 40 is positionable over the mounting collar 30 having a centrally disposed aperture 42 that is sized to be placed over the mounting collar 30 with an outer edge 44 of a diameter so as to provide extended support to the support surface 20 allowing a minimal footprint when mounting to a façade. The support ring 40 is preferably made out of a metal or rigid fiber material to provide extended support. A first insulating ring 50 is positionable over the support ring 40, and is made of a non-conductive material such as rubber, cork, paper, plastic or the like. The first insulating ring 50 is further positionable over the mounting collar 30, having a central aperture 52 sized for placement over the mounting collar and an outer edge 54 of a diameter so as to make use of the support surface provided by the support ring 40, and for support of the first connector 60. The first connector 60 is formed from a disk base 62, having a centrally disposed aperture 64, formed integral with a first terminal strip 66 and a second terminal strip 68. Each of the terminal strips 66, 68 extend obliquely and symmetrically from an outer edge 70 of the first disk base 62, with the first terminal strip 66 having a proximal end 72 extending from first disk base 62 to a distal end 74; the second terminal strip 78 having a proximal end 76 extending to a distal end 78 forming a mirror image of the first terminal strip 66. The first and second terminal strips 66, 68 have a length from the distal end to the proximal end sized to engage a groove 108 on the audio plug 100. As illustrated, the first and second terminal strips are biased inward to provide a uniform clamping against the groove, and include scallop formations depicted as numerals 80 and 82 which are constructed and arranged to grasp a portion of the groove, creating a semi-circular attachment to the groove 108 to provide contact not only with the groove, but with the tip section 110 directly above the groove 108. The first connector 60 includes a coupling tab 84, of which a wire may be secured thereto. The tab 84 provides a resistant-free connection to the first and second terminal strips 66 and 68, and positive engagement to the audio jack 100 through electrically coupling to the groove 108.

A second insulating ring 90 is made of a non-conductive material, having a centrally disposed aperture 92 and an outer edge 94 having terminal strip sections 96, 98 for receipt of terminal strips 66, 68. The terminal strips 66, 68 maintain second insulating ring 90 in a fixed position. An alignment section 120 is provided for receipt of a second connector 122, having an alignment tab 124. The alignment tab 124 is positionable within alignment section 120 so as to maintain the first and second terminal strips 66, 68 at right angles to terminal strips 126, 128 of the second connector 122, the alignment tab 124 extending downward so to engage alignment section 120 to prevent movement of the insulating ring 90, and thus the first connector 60.

Terminal strips 126, 128 are each based upon a second disk base 130 having an inner aperture 132 which frictionally engages the shaped edge 36 of the upper portion of the mounting collar 30, securing the rings 40, 50 and 90, and connectors 60 and 122 to the support housing 20. The second connector 122 can be snapped onto the support housing 20, or threaded onto the support housing if the aperture 132 has threads to meet reciprocal threads that can be formed on the shaped section 36 of the mounting collar 30. The terminal strip 126 has a proximal end 134 and a distal end 136 of a length so as to engage sleeve 102 of the audio plug 100. Similarly, terminal strip 128 has a proximal end 140 and a distal end 142 with both distal ends 136, 142 having a scalloped façade 144 and 152, so as to engage the larger surface area of the sleeve 102. Each scalloped façade 144 and 152 is arranged to impact a greater portion of the sleeve 102 to eliminate resistance between the terminal contacts.

The second connector 122 includes a tab 148 for securement to an electrical wire for carrying of audio signals. In this manner, the sleeve can be a negative connection and the second connector 122 recipient of the negative connection. The tip 110 may be a positive connection, and the first connector 60 the recipient of the positive connection.

For ease of clarification, a ¼ inch plug and audio jack assembly has been disclosed and illustrated. However, it is obvious to one skilled in the art and to be understood that the audio jack assembly illustrated can be scaled to received ⅛ inch plug or micro plug sizes using the same terminal configuration. The claims of this invention are not limited to the size of plug and are applicable to ¼ inch, ⅛ inch, or micro plugs.

All patents and publications mentioned in this specification are indicative of the levels of those skilled in the art to which the invention pertains. It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims. The term "coupled" is defined as connected, although not necessarily directly, and not necessarily mechanically.

What is claimed is:

1. An audio jack assembly for receiving a conventional audio plug having a cylindrical shaped sleeve with a grooved tip electrically isolated from said sleeve, wherein the sleeve operates as a negative connector and the grooved tip operates as a positive connector comprising:

a support housing having a passageway sized to receive the audio plug, said support housing having an entry collar, a support surface adjoining said entry collar, and a mounting collar adjoining said support surface;

a first insulating ring positionable on said mounting collar;

a first connector having a first disk base with a centrally disposed aperture, said first disk base supporting first and second terminal strips each having a proximal end formed integral with said first disk base and extending obliquely from an outer edge of said first disk base to a distal end positioned to symmetrically and uniformly engage the grooved tip of an audio plug from either side of said aperture by contact with said first terminal strip of said first connector positioned on one side of the grooved tip with said second terminal strip of said first connector positioned 180 degrees thereto along the opposite side of the grooved tip when an audio plug is engaged, said first connector positionable on said mounting collar and electrically isolated from said support surface by said first insulating ring;

a second insulating ring positionable on said mounting collar;

a second connector having a second disk base with a centrally disposed aperture and first and second terminal strips each having a proximal end extending obliquely from an outer edge of said second disk base to a distal end positioned to symmetrically and uniformly engage said sleeve from either side of said aperture to provide contact with said first terminal strip of said second connector positioned on one side of the sleeve with said second terminal of said second connector positioned 180 degrees thereto along the opposite side of the sleeve when the audio plug is engaged, said second connector on said mounting collar at a position 90 degrees to said first connector, said second connector electrically isolated from said first connector by said second insulating ring;

wherein said second connector is fastened to said support housing, securing said first connector therebetween.

2. The audio plug assembly according to claim 1 wherein said entry collar has a first diameter, said support surface has a second diameter, and said mounting collar has a third diameter, said second diameter greater than said first diameter.

3. The audio plug assembly according to claim 1 wherein said mounting collar is shaped and said aperture of said second connector includes a reciprocal shape for securing to said mounting collar.

4. The audio plug assembly according to claim 1 wherein first insulating ring includes a centrally disposed opening sized to fit over said mounting collar.

5. The audio plug assembly according to claim 1 wherein said second insulating ring includes a centrally disposed opening sized to fit over said mounting collar.

6. The audio plug assembly according to claim 5 wherein said second insulating ring includes an outer edge having at least one notch for receipt of at least one terminal, said notch maintaining said terminal strip in predetermined axial alignment.

7. The audio plug assembly according to claim 1 wherein said distal ends of each said first connector terminal strip includes a scallop shape constructed and arranged to engage a section of said sleeve.

8. The audio plug assembly according to claim 1 wherein said distal ends of each said second connector terminal strip includes said scallop shape constructed and arranged to engage a section of said groove.

* * * * *